US008607984B2

(12) United States Patent
Breton et al.

(10) Patent No.: US 8,607,984 B2
(45) Date of Patent: Dec. 17, 2013

(54) CUP AND BOWL CARRIER

(75) Inventors: Donald V. Breton, N. Vassalboro, ME (US); Keegan Y. Yang, Winslow, ME (US)

(73) Assignee: Huhtamaki, Inc., Desoto, KS (US)

( * ) Notice: Subject to any disclaimer, the term of this patent is extended or adjusted under 35 U.S.C. 154(b) by 247 days.

(21) Appl. No.: 12/836,986

(22) Filed: Jul. 15, 2010

(65) Prior Publication Data

US 2012/0012500 A1 Jan. 19, 2012

(51) Int. Cl.
*B65D 1/34* (2006.01)

(52) U.S. Cl.
USPC ..... 206/563; 206/427; 206/564

(58) Field of Classification Search
USPC ..... 206/563, 427, 486, 501, 502, 503, 505, 206/565, 564, 433, 557
See application file for complete search history.

(56) References Cited

U.S. PATENT DOCUMENTS

| | | | | |
|---|---|---|---|---|
| 1,757,689 | A | 5/1930 | Strickland | |
| 3,295,737 | A | 1/1967 | Page et al. | |
| 3,955,672 | A | 5/1976 | Brundage | |
| 4,208,006 | A | 6/1980 | Bixler et al. | |
| 4,218,008 | A | 8/1980 | Veilleux | |
| D302,122 | S | 7/1989 | Ashby | |
| D309,258 | S | 7/1990 | Vigue | |
| D319,579 | S | 9/1991 | Vigue | |
| 5,096,065 | A * | 3/1992 | Vigue | 206/564 |
| D331,008 | S | 11/1992 | Vigue | |
| 5,713,619 | A * | 2/1998 | DuBois et al. | 294/159 |
| 5,915,561 | A | 6/1999 | Lorenzana et al. | |
| 6,036,020 | A | 3/2000 | Distler | |
| 6,076,876 | A | 6/2000 | Letourneau et al. | |
| D438,100 | S | 2/2001 | Cekota | |
| 6,398,056 | B1 * | 6/2002 | Letourneau et al. | 220/23.8 |
| 6,409,021 | B1 * | 6/2002 | Ramirez et al. | 206/564 |
| 6,651,836 | B1 | 11/2003 | Hofheins et al. | |
| 6,679,380 | B2 | 1/2004 | Brown | |
| 7,185,763 | B2 | 3/2007 | Ali | |
| 7,225,927 | B2 | 6/2007 | Sweeney | |
| 7,762,396 | B1 * | 7/2010 | Yang et al. | 206/427 |

FOREIGN PATENT DOCUMENTS

| | | | |
|---|---|---|---|
| EP | 1489014 | A1 | 12/2004 |
| WO | 9810687 | A1 | 3/1998 |
| WO | 2006065132 | A2 | 6/2006 |

* cited by examiner

*Primary Examiner* — Andrew Perreault
(74) *Attorney, Agent, or Firm* — Husch Blackwell LLP

(57) ABSTRACT

A tray having a socket configured for holding containers of different sizes is provided. The tray includes a socket having a lower portion configured for accommodating a first container, such as a beverage cup, and an upper portion configured for accommodating a second container, such as a bowl, having a base that is larger than the base of the first container. The lower portion of the socket includes a plurality of inwardly-sloping stabilizing walls extending therein that are adapted for supporting a commonly-sized beverage cup within the lower portion of the socket. The upper portion of the socket comprises a shelf structure that is surrounded by a plurality of stabilizing shoulders for supporting a bowl therein. The socket is thus adapted for optionally holding either a beverage cup within the lower portion or a bowl within the upper portion.

23 Claims, 3 Drawing Sheets

CUP AND BOWL CARRIER

CROSS-REFERENCE TO RELATED APPLICATIONS

None.

BACKGROUND OF THE INVENTION

Carrying trays for holding and carrying beverage cups are well-known and in widespread use throughout fast-food restaurants, stadiums, convenience stores, coffee shops and the like. These carrying trays are normally disposable and often constructed of molded pulp or a like material.

Typically, the trays are comprised of a main body portion provided with a number of cup-holding sockets. The number of cup-holding sockets can vary, depending on the style of the carrying tray. Multiple designs exist, each having different shapes and sizes of cup-holding sockets with varying degrees of accommodation for beverage cups of different shapes and sizes.

Over time, the demands on these carrying trays have evolved. In recent years, fast-food and delicatessen restaurants have expanded their menus to include a variety of items, including soups and other items served in bowls. It is important that the customer can readily handle the purchased food, including soups and other foods placed in bowls, along with the beverages in a convenient and safe manner. It is desirable for the customer to be able to carry multiple containers of various sizes, including cups and bowls, in a single carrying tray. It is also desirable for single carrying tray to be adapted for carrying both cups and bowls, either concurrently or independently of one another.

Accordingly, a need exists for a cup and bowl carrier capable of concurrently carrying a combination of both beverage cups and bowls. A need also exists for a container carrier that includes at least one socket capable of holding either a cup or a bowl. A further need exists for a container carrier having a socket with a shelf structure for supporting a bowl surrounded by a plurality of stabilizing shoulders for holding the bowl in place.

SUMMARY OF THE INVENTION

The present invention involves the provision of a tray having a socket configured for holding containers of different sizes. The tray includes a socket having a lower portion configured for accommodating a first container, such as a beverage cup, and an upper portion configured for accommodating a second container, such as a bowl, having a base that is larger than the base of the first container. The lower portion of the socket includes a plurality of inwardly-sloping stabilizing walls extending therein that are adapted for supporting a commonly-sized beverage cup within the lower portion of the socket. The upper portion of the socket comprises a shelf structure recessed therein that is surrounded by a plurality of stabilizing shoulders for supporting a bowl. The socket is thus adapted for optionally holding either a beverage cup within the lower portion or a bowl within the shelf structure of the upper portion. Furthermore, the tray may be adapted for concurrently holding a relatively short cup or other contents within the lower portion of the socket and a bowl within the shelf structure of the upper portion, in a manner in which the bowl overlies the short cup or other contents.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
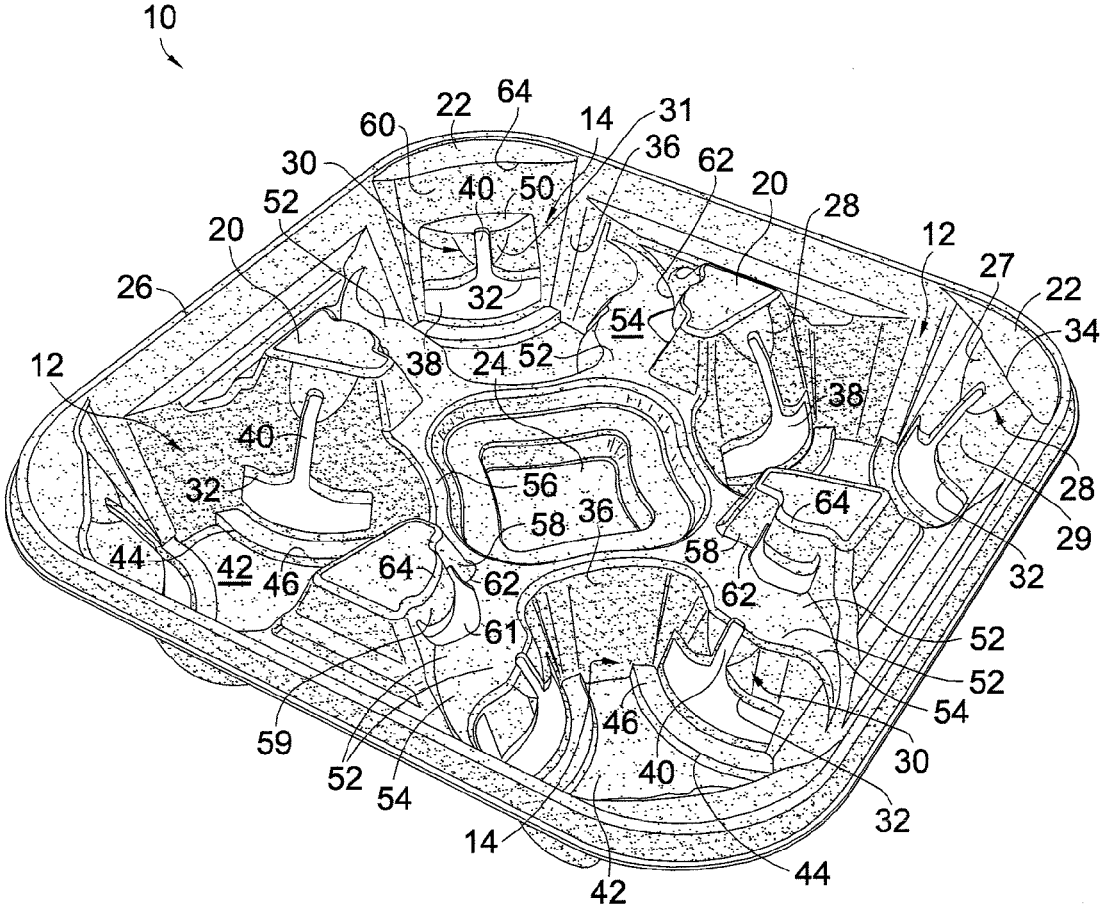
FIG. 1 is a top perspective view of a cup and bowl carrier in accordance with one embodiment of the present invention.
Figure 2:
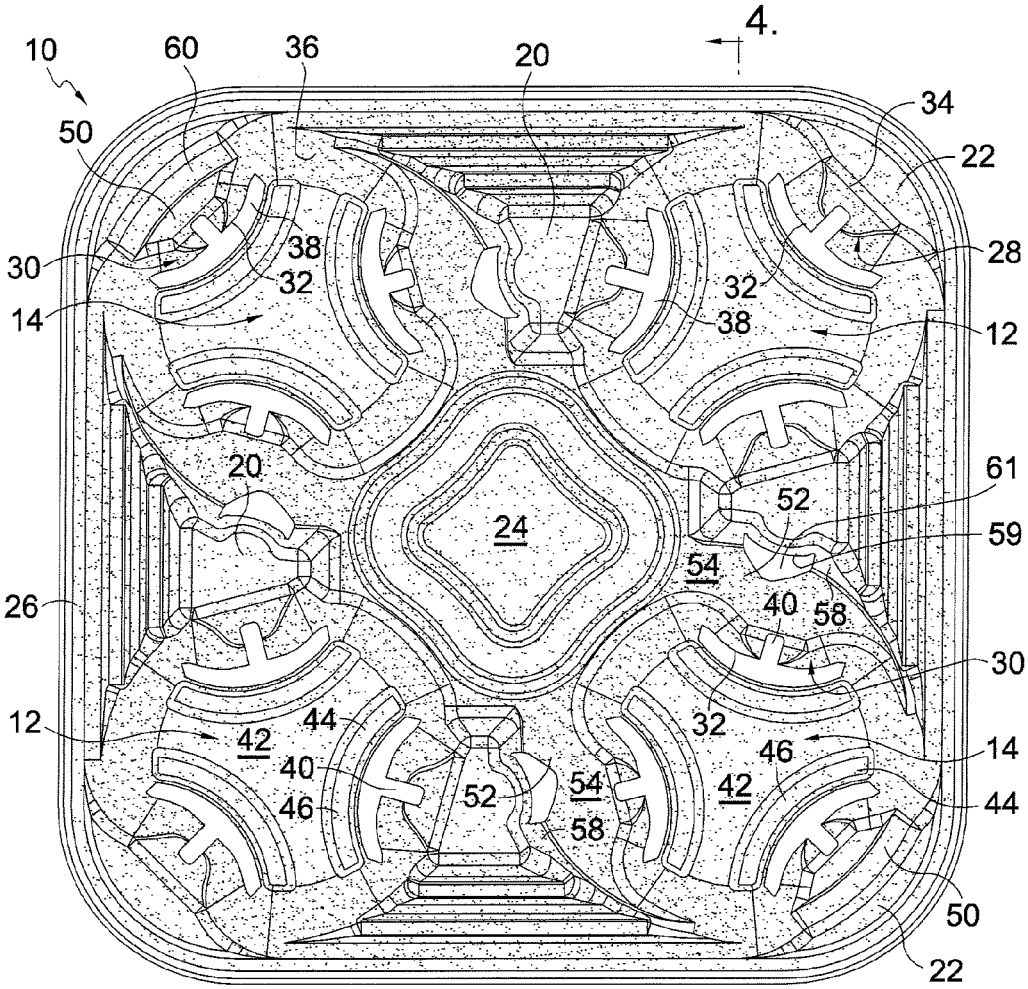
FIG. 2 is a top side view of a cup and bowl carrier in accordance with one embodiment of the present invention.
Figure 3:
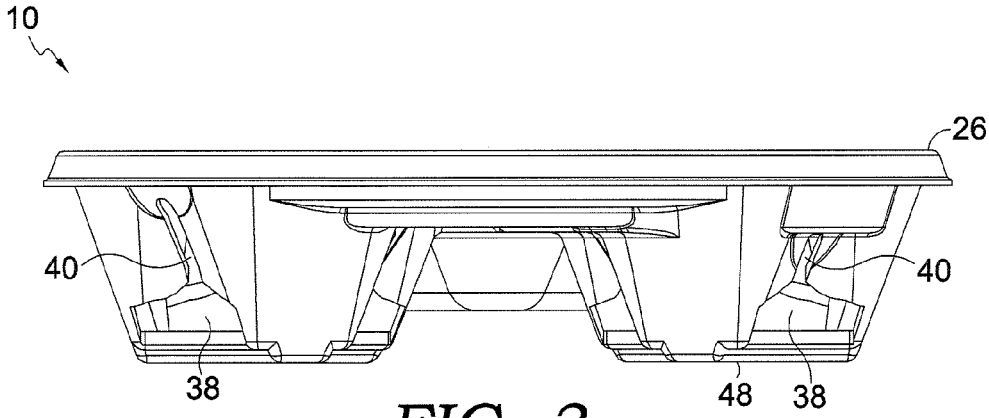
FIG. 3 is a side view of a cup and bowl carrier in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Reference numeral 10 designates generally a cup and bowl carrier 10 formed of a resilient material, such as molded fibrous pulp. The cup carrier 10 may be manufactured by molding fibrous pulp against molds or dies in a process and manner well-known in the art. In other embodiments, the cup carrier 10 may be made from other materials, such as plastics, foams, or other materials having desirable strength and resiliency.

The carrier 10 has at least one container-holding socket 12 and 14 molded therein to securely hold a container. As shown in FIG. 1, the carrier 10 includes four sockets 12 and 14, one being provided in each corner of the carrier 10, with a center cavity 24 positioned therebetween.

As illustrated in FIG. 1, two of the sockets 12 are configured generally for accommodating beverage cups or other containers or object with similarly-sized bases. The other two sockets 14 are configured generally for optionally accommodating either (a) beverage cups or other containers or objects with similarly-sized bases, or (b) bowls or other containers or objects with similarly-sized bases. In other words, socket 14 is essentially designed to hold either a beverage cup or a bowl.

However, the carrier 10 can take on different configurations and numbers of sockets 12 and 14. For example, in one embodiment, the carrier 10 includes one or two sockets 12 and 14 with the remainder of the carrier 10 comprising a substantially flat food carrying surface. The carrier 10 can also include a downturned continuous peripheral rim or flange 26.

Figure 4:
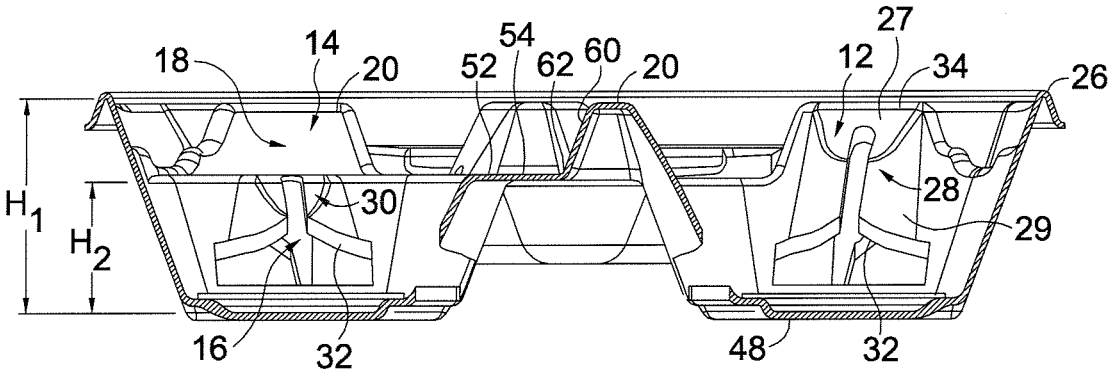
FIG. 4 is a cross-section view of the cup and bowl carrier shown in FIG. 2 taken generally along line 4-4 in the direction of the arrows.

Each socket 12 and 14 may comprise stabilizing shoulders 20 and 22 positioned in a spaced apart arrangement around the socket 12 and 14. As shown in the figures, each socket 12 and 14 is surrounded by two interior stabilizing shoulders 20 that extend upwardly from a interior portion of the carrier 10 and one exterior stabilizing shoulder 22 formed in the corner of the carrier 10 in which the respective socket 12 and 14 is located. As depicted, the stabilizing shoulders 20 and 22 are spaced substantially equidistantly around each socket 12 and 14. The stabilizing shoulders 20 and 22 may extend upwardly to a height similar to the height of the top surface of the carrier's peripheral rim 26, as depicted in FIG. 4, or may be extend to a height above or below the top surface of the rim 26.

As mentioned above, sockets 12 are each generally configured for accommodating beverage cups or containers having similarly-sized bases. Sockets 14 are each generally configured for optionally holding either (a) beverage cups or containers having similarly-sized bases, or (b) bowls or containers or containers having similarly-sized bases.

Each socket 12 includes stabilizing walls 28 extending downwardly and inwardly from each surrounding stabilizing shoulder 20 and 22 into the socket 12 for supporting a commonly-sized beverage cup within the socket 12. Each stabilizing shoulder 20 and 22 and corresponding stabilizing wall 28 form a corner or junction 34 from which the stabilizing wall 28 extends. As shown, each stabilizing wall 28 terminates in a lower edge 32 located above a socket floor 42 thereby resulting in openings 38 around the base of the socket 12.

As best illustrated in FIG. 1, each stabilizing wall 28 includes an upper or lead-in portion 27 and a lower portion 28. The upper portion 27 has a downward slope that is shallower than the downward slope of the lower portion 29. The configuration of each stabilizing wall 28 affords the socket 12 the ability to contact both small and large cups at a desired point on the sides of the cups by extending the stabilizing wall 28 further into a top portion of the socket 12, thereby enabling the stabilizing wall 28 to contact smaller diameter cups at a relatively higher point, thus providing increased stability, while still enabling the socket 12 to accommodate larger diameter cups.

As shown in the figures, each stabilizing wall 28 may optionally include a slot 40 which vertically bisects the wall 28. The slot 40 may extend upward from an opening 38, which is defined between the lower edge 32 of the stabilizing wall 28 and the socket floor 42. The slot 40 may terminate at a point below the stabilizing shoulders 20 and 22. The configuration formed by the opening 38 and slot 40 is commercially known as a T-Slot®. However, while a T-Slot® configuration is illustrated in the figures, it will be understood that in other embodiments, different types of openings and slots may be defined through the stabilizing walls 28. For example, in other embodiments, the configuration defined through the stabilizing wall 28 may take the form of a triangle, a rectangle, an inverted Y-shape, or any other suitable configuration now known or hereafter developed.

The stabilizing walls 28 are deflected outwardly when a cup is inserted into the cup-holding socket 12. The deflection and yieldability of the stabilizing walls 28 can be controlled by adjusting the thickness, density, nature of material, the shape and size of any opening or slots in the stabilizing walls 28, and/or angle of the walls 28. The material, such as molded pulp, should have a resiliency such that the deflected walls 28 exert a gripping force on the inserted cup, regardless of the cup size.

The sockets 12 also include sidewall portions 36 extending between each stabilizing wall 28. Additionally, the sockets 12 can have a floor 42 that includes an upwardly extending rib 44 having a top surface 46 upon which a cup can rest. The socket floor 42 is integrally molded with sidewall portions 36 that are located around socket 12 between the stabilizing shoulders 20 and 22.

Turning attention now to sockets 14, it is shown in FIG. 4 that sockets 14 each have a lower portion 16 and an upper portion 18. The lower portion 16 of each socket 14 is designed to hold and support a beverage cup or a similarly sized and shaped container, while the upper portion 18 is designed to hold and support a bowl or a similarly sized and shaped container. Like sockets 12, sockets 14 also include stabilizing walls 30 extending downwardly and inwardly into the lower portion 16 of the socket 14 for supporting a beverage cup or similar container within the socket 14. As best illustrated in FIG. 1, each stabilizing wall 30 may include an upper or lead-in portion 31, thereby allowing larger diameter cups to enter the socket 14 easier, while still enabling the socket 14 to accommodate and grip cups of smaller diameters.

Like sockets 12, the stabilizing walls 30 in sockets 14 can each terminate in a lower edge 32 located above the socket floor 42 thereby resulting in openings 38 around each base of the socket 14. Each stabilizing wall 30 may optionally include a slot 40 which vertically bisects the wall 30. The slot 40 may extend upward from an opening 38, which is defined between the lower edge 32 of the stabilizing wall 30 and the socket floor 42. The configuration formed by the opening 38 and slot 40 is commercially known as a T-Slot®. However, while a T-Slot® configuration is illustrated in the figures, it will be understood that in other embodiments, different types of openings and slots may be defined through the stabilizing walls 30. For example, in other embodiments, the configuration defined through the stabilizing wall 30 may take the form of a triangle, a rectangle, an inverted Y-shape, or any other suitable configuration now known or hereafter developed.

The sockets 14 also include sidewall portions 36 extending between each stabilizing wall 30. Additionally, the sockets 14 can have a floor 42 that includes an upwardly extending rib 44 having a top surface 46 upon which a cup can rest. The socket floor 42 is integrally molded with sidewall portions 36 that are located around socket 14 between the stabilizing shoulders 20 and 22.

The sockets 14 include a shelf structure recessed into the upper portion 18 thereof. The shelf structure may be formed of one or more shelves 50 and 52. In the illustrated embodiment, each socket 14 has two shelves 52 that are generally recessed into the two interior stabilizing shoulders 20 and one shelf 50 that is generally recessed into the exterior stabilizing shoulder 22. However, it will be understood by one of ordinary skill in the art that the shelf structure may take on any suitable configuration, including having more than three or less than three shelves. For example, the shelf structure may be formed of a single, substantially continuous shelf that surrounds substantially the entire socket 14. A container held within the shelf structure can rest upon a top surface 54 of the shelves 50 and 52.

As illustrated best in FIGS. 1 and 4, the shelf structures are surrounded by sidewalls 58 formed into the sides of stabilizing shoulders 20 and a sidewall 60 formed into the side of stabilizing shoulder 22. The sidewalls 58 and 60 can be slightly tapered inwardly. Upper inner edges 64 of stabilizing shoulders 20 and 22 define the size of the shelf structure opening, and thus the size and shape of the base of the widest container that may be received within the shelf structure. Lower corner edges 62 of stabilizing shoulders 20 and 22 define the size of the shelf structure base, and thus the size and shape of the base of the widest container that may rest on the shelf surface 54.

Each sidewall 58 and 60 may optionally include an opening or slot 61 such as a triangle, rectangle, inverted-Y shape or other shape designed to adjust its deflection and yieldability when a container is inserted. Each sidewall 58 and 60 may further include an inwardly directed projection or buttress 59 that extends into the upper portion 18 of the socket 14. The projection 59 creates an interference fit with a bowl or other large diameter container placed within the upper portion 18 of the socket 14. When the bowl is placed within the socket 14, the projections 59 collapse allowing the bowl to fit within the socket 14 while still providing enough friction to hold the bowl in place. As shown in FIG. 1, only the sidewalls 58 proximate the interior stabilizing shoulders 20 are designed to include a projection 59 and corresponding opening 61.

The recessed shelf structures may be of any suitable size and shape and may be adapted to receive containers of more than one size or shape. For example, the shelf structure may be shaped such that it can receive containers having circular bases, rectangular bases or bases of any other shape. The carrier 10 may also include two or more shelf structures of different sizes and/or shapes to further increase the carrier's 10 ability to hold a variety of containers of different shapes and sizes.

As shown in the figures, the recessed shelf structure generally overlies the lower portion 16 of the socket 14. However, it will be understood that the shelf structure may be offset from the lower portion 16 or extend substantially therebeyond. As depicted in FIG. 1, the center cavity 24 is inset into and surrounded by a surface 56. Surface 56 may be in substantially the same plane as the top surface 54 of shelves 50 and 52. Thus, as an optional alternative to bowls, the carrier 10 may also be adapted for carrying longer objects or containers (e.g., tacos, burritos, hot dogs or containers and sleeves enclosing the same) diagonally across the carrier 10 on surfaces 54 and 56. Additionally, the recessed shelf structure may be used for carrying a sandwich while the lower portion 16 of the socket 14 may simultaneously hold the accompanying condiments therein.

In addition to holding commonly-sized beverage cups, the lower portion 16 of socket 14 may be configured to accommodate smaller containers, for example, disposable paper or plastic condiment cups, soufflé cups, portion cups and the like. These smaller containers can be of a height such that they may be housed within the lower portion 16 of the socket 14 underneath a larger container, such as a bowl, being held in the upper portion 18 of the socket 14. In other words, socket 14 may be adapted to simultaneously hold a relatively small container in its lower portion 16 and a relatively larger-based container or object in its upper portion 18.

The shelf structure is recessed roughly half way into the depth of the socket 14. However, it will be understood that the shelf structure may be recessed to any suitable depth. As illustrated in FIG. 4, the socket has depth or height $H_1$. The socket's 14 height $H_1$ can be between about 1 and 4 inches, and in one embodiment is approximately 2 inches. As also illustrated in FIG. 4, the top surfaces 54 of the shelve members 50 and 52 are position within the sockets 14 at a height $H_2$. Height $H_2$ can be between about 0.5 and 3 inches, and in one embodiment is approximately 1.2 inches.

The carrier 10 may be configured to accommodate many different combinations of bowls, cups and other containers. For example, the carrier 10 shown in the figures is generally square- or rectangular-shaped and includes four sockets 12 and 14. The illustrated carrier 10 is capable of simultaneously accommodating a variety of combinations, for example (i) four cups, (ii) two cups and two bowls, (iii) three cups and one bowl and (iv) any other suitable combination of cups, bowls and other containers.

The carriers 10 are readily stackable and shaped to permit empty trays to be nested, one within another, to form a convenient and compact stack for shipment and storage prior to use. In one embodiment, the carriers 10 are designed and manufactured such that when 100 carriers 10 are stacked, the stack of carriers 10 is approximately 25 inches high.

From the foregoing, it may be seen that the cup and bowl carrier of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A tray for holding different sized containers, said tray comprising:

at least one container-holding socket having a socket height and a socket floor located at a first level and said socket having a lower portion and an upper portion, said lower portion being adjacent to said socket floor and extending upwardly therefrom, said lower portion at least partially defined by a lower sidewall, said lower portion of said socket configured to receive a first container having a base with a first area, and wherein said upper portion is above said lower portion and at least partially defined by an upper sidewall wherein said upper portion of said socket is configured to receive a second container having a base with a second area, and wherein said second area is larger than said first area; and a shelf structure having at least one shelf at a shelf height above the socket floor, wherein said shelf at least partially defines a transition between the lower portion and the upper portion of said container-holding socket and wherein said shelf structure includes one of said shelf structure circumscribing a majority of the lower portion of said socket and the shelf height being greater than or equal to one-third the socket height, said shelf structure being located at a second level wherein said second level is above said first level and said shelf structure configured for said second container to bear at least partially on said at least one shelf when said second container is received into said upper portion of said socket.

2. The tray of claim 1, wherein said first container is a cup and said second container is a bowl.

3. The tray of claim 2, said tray being adapted for optionally holding either a beverage cup within said lower portion of said socket or said bowl within said upper portion of said socket.

4. The tray of claim 2, said tray being adapted for concurrently holding a relatively short cup within said lower portion of said socket and a bowl within said upper portion of said socket, wherein said bowl overlies said cup.

5. The tray of claim 1, wherein said lower portion of said container-holding socket includes at least one inwardly-sloping stabilizing wall extending into said lower portion below said shelf structure for supporting said first container when inserted therein.

6. The tray of claim 5, wherein each said at least one stabilizing wall has at least one said shelf located generally thereabove.

7. The tray of claim 1, wherein said socket floor includes a floor surface upon which said first container rests when inserted into said lower portion of said container-holding socket.

8. The tray of claim 7 further comprising a center portion located between a plurality of said container-holding sockets, said center portion having an upper surface positioned in substantially the same horizontal plane as said shelf surface.

9. The tray of claim 1 further comprising at least two stabilizing shoulders positioned in a spaced apart arrangement around said container-holding socket.

10. The tray of claim 1 further comprising at least two stabilizing shoulders positioned in a spaced apart arrangement adjacent to said socket and above said shelf structure.

11. The tray of claim 10, wherein said at least one shelf of said shelf structure are partially recessed into said stabilizing shoulders.

12. The tray of claim 1 further comprising at least one projection on said upper sidewall, said projection extending inwardly into said upper portion of said container-holding socket and positioned above said shelf of said shelf structure for supporting said second container when inserted into said upper portion.

13. The tray of claim 1, wherein said tray is of a generally rectangular shape with four corners and includes one said container-holding socket in two of said four corners.

14. The tray of claim 13, wherein two of said container-holding sockets are positioned diagonal one another.

15. The tray of claim 1, wherein said tray is formed at least partially of molded pulp.

16. The tray of claim 1 wherein at least a portion of said shelf structure is located along at least a portion of a periphery of said lower portion and along at least a portion of at least a periphery said upper portion of said container-holding socket.

17. A socket of a container carrying tray, said socket comprising:

a floor comprising a first contacting surface upon which a first container rests when inserted into said socket;

a lower portion having a lower socket area to receive a first container, said lower portion being at least partially defined by a lower sidewall, said lower portion extending upwardly from said floor;

a shelf structure positioned at a shelf height above the floor and having an inner edge and an outer edge, said shelf structure located above said lower portion and said floor of said socket wherein said lower portion terminates at said inside edge of said shelf structure, said shelf structure comprising a second contacting surface lying substantially parallel to said floor;

an upper portion having an upper socket area to receive a second container, said upper portion being at least partially defined by an upper sidewall wherein said upper portion extends upwardly from said outer edge of said shelf structure and terminating at a stabilizing shoulder positioned adjacent to said socket, said stabilizing shoulder being above said shelf structure, wherein said upper socket area is larger than said lower socket area;

and wherein said upper portion and said lower portion define a socket height and wherein said shelf structure includes one of said shelf structure circumscribing a majority of the lower portion of said socket and the shelf height being greater than or equal to one-third the socket height.

18. The tray of claim 17 further comprising at least one protrusion extending radially inward from said upper sidewall for gripping said second container.

19. The tray of claim 18 where said at least one protrusion is collapsible.

20. A tray for holding different sized containers, said tray comprising:

at least one container-receiving socket having a floor, a socket height, and at least partially defined by a stepped sidewall;

said stepped sidewall having a lower portion, an outward step, and an upper portion;

said lower portion having a first end and a second end, said first end proximate said floor and said second end proximate said step;

said step extending from said second end of said lower portion outwardly to a first end of said upper portion in a plane substantially parallel to said floor, said step occurring at a step height above the floor; and said upper portion extending upwardly from said step;

wherein said step defines at least a portion of a shelf, and wherein said socket includes one of the step circumscribing at least a majority of said lower portion of said stepped sidewall, and said step height being greater than or equal to one-third the socket height.

21. The tray of claim 20 further comprising at least one protrusion extending radially inward from said upper portion of sidewall into said socket.

22. The tray of claim 21 where said at least one protrusion is collapsible.

23. The tray of claim 20 wherein said tray has a rectangular shape and comprises at least two container-receiving pockets diagonally opposed.

* * * * *